US009718585B2

(12) United States Patent
Giorgio et al.

(10) Patent No.: US 9,718,585 B2
(45) Date of Patent: Aug. 1, 2017

(54) PACKAGE INTEGRITY FEATURE FOR PACKAGING

(71) Applicant: Sonoco Development, Inc., Hartsville, SC (US)

(72) Inventors: Hugo Giorgio, Franklin, IN (US); Eugene T. Smith, Charlotte, NC (US); Joseph Donald Gagne, Holyoke, MA (US); Jacob Donald Prue Branyon, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 108 days.

(21) Appl. No.: 14/539,316

(22) Filed: Nov. 12, 2014

(65) Prior Publication Data

US 2016/0130041 A1 May 12, 2016

(51) Int. Cl.

| | |
|---|---|
| ***B65D 33/34*** | (2006.01) |
| ***B65D 33/16*** | (2006.01) |
| ***B65D 75/58*** | (2006.01) |

(52) U.S. Cl.

CPC ..... *B65D 33/34* (2013.01); *B65D 33/1691* (2013.01); *B65D 75/5833* (2013.01); *B65D 2101/00* (2013.01); *B65D 2575/586* (2013.01)

(58) Field of Classification Search

CPC ..... B65D 75/5838; B65D 75/5855; B65D 2575/586; B65D 2101/00; B65D 33/34; B65D 33/1691; B65D 75/5833; B31B 2219/90

USPC ..... 383/5; 220/214

See application file for complete search history.

(56) References Cited

U.S. PATENT DOCUMENTS

| | | | | |
|---|---|---|---|---|
| 4,552,269 | A * | 11/1985 | Chang | B65D 75/5838 229/125.09 |
| 5,908,246 | A | 6/1999 | Arimura et al. | |
| 6,983,875 | B2 * | 1/2006 | Emmott | B65D 5/54 229/313 |

(Continued)

FOREIGN PATENT DOCUMENTS

| | | | |
|---|---|---|---|
| EP | 0 546 369 | A1 | 6/1993 |
| EP | 1 975 081 | A1 | 10/2008 |
| EP | 2 368 811 | A1 | 9/2011 |

OTHER PUBLICATIONS

International Search Report and Written Opinion for Application No. PCT/IB2015/056996 dated Nov. 2, 2015.

*Primary Examiner* — Peter Helvey
(74) *Attorney, Agent, or Firm* — Alston & Bird LLP

(57) ABSTRACT

A reclosable package is described that includes a package integrity feature defined by an inner film layer of the package. The package integrity feature includes a first die cut portion and a second die cut portion that both extend from a main die cut portion at least partially defining the opening of the package. The first and second die cut portions are continuous with each other and with the main die cut portion, such that they are defined by a single cut line. In some cases, the package integrity feature includes a neck region that tears when the package is opened and an anchor region that resists delamination. Because the first and second die cut portions are continuously formed with each other, the anchor region may have a circular or elliptical shape and is, thus, easier and more consistently manufactured, allowing for better performance.

24 Claims, 4 Drawing Sheets

(56) References Cited

U.S. PATENT DOCUMENTS 7,007,423 B2 * 3/2006 Andersson ..... G09F 3/10 206/1.5
7,228,968 B1 * 6/2007 Burgess ..... B65D 75/5838 206/233
7,344,744 B2 3/2008 Sierra-Gomez et al.
7,371,008 B2 5/2008 Bonenfant
7,717,620 B2 5/2010 Hebert et al.
7,744,517 B2 6/2010 Bonenfant
8,408,792 B2 4/2013 Cole et al.
2004/0150221 A1 8/2004 Brown
2004/0206637 A1 * 10/2004 Sierra-Gomez .... B65D 75/5838 206/1.5
2005/0247764 A1 * 11/2005 Sierra-Gomez .... B65D 75/5838 229/87.08
2005/0276525 A1 * 12/2005 Hebert ..... B29C 59/007 383/203
2006/0018569 A1 * 1/2006 Bonenfant ..... B65D 75/5838 383/5
2006/0144911 A1 * 7/2006 Sierra-Gomez .... B65D 75/5838 229/123.1
2006/0171611 A1 * 8/2006 Rapparini ..... B65D 75/5838 383/66
2007/0023436 A1 * 2/2007 Sierra-Gomez .... B65D 75/5838 220/359.2
2007/0275133 A1 * 11/2007 Sierra-Gomez ..... B65D 75/44 426/122
2008/0037911 A1 * 2/2008 Cole ..... B65D 75/5838 383/203
2008/0156861 A1 * 7/2008 Sierra-Gomez .... B65D 75/5838 229/214
2008/0240627 A1 * 10/2008 Cole ..... B65D 75/5838 383/204
2009/0226117 A1 9/2009 Davis et al.
2010/0002963 A1 * 1/2010 Holbert ..... B65D 75/5838 383/204
2010/0018974 A1 * 1/2010 Lyzenga ..... B65D 75/5838 220/214
2010/0019022 A1 * 1/2010 Ryan ..... B65D 5/563 229/122
2010/0172604 A1 * 7/2010 Andersson ..... B65D 75/366 383/211
2010/0278454 A1 * 11/2010 Huffer ..... B65D 75/5838 383/5
2013/0064934 A1 * 3/2013 Vogt ..... B65D 75/5838 426/106
2013/0121624 A1 5/2013 Lyzenga et al.

* cited by examiner

PACKAGE INTEGRITY FEATURE FOR PACKAGING

BACKGROUND

The present disclosure relates in general to packaging for products, and more particularly to packaging constructed from flexible film-based materials. The disclosure is especially concerned with packages having one or more package integrity features for providing an indication of tampering to a consumer.

Flexible film-based materials are commonly employed for constructing packages for products that can be dispensed from an opening in the package created when one layer of a multi-laminate construction is peeled away from another layer. Often, such packages are used to hold contents that are intended for dispensing only to the consumer buying the package, such as food items (e.g., cookies) and other types of contents that may be contaminated, diminished in value or quality, or otherwise degraded by the inspection or handling of those other than the ultimate consumer of the particular package. To provide an indication of tampering that may have occurred, for example as the result of a premature opening of the package by someone other than the consumer buying or intending to buy the package, such packages may be designed with package integrity features that make it apparent when a package has been opened, even after the package has been reclosed.

BRIEF SUMMARY

Embodiments of the invention described herein provide improved package integrity features for packages that provide an indication that a package has been opened in a more consistent, more functional, and more easy-to-produce manner. In some embodiments, a package integrity feature may be provided that is defined by an inner film layer of a package. The package integrity feature may comprise a first die cut portion extending from a main die cut portion, wherein the main die cut portion at least partially defines an opening of the package, and a second die cut portion extending from the main die cut portion. The first and second die cut portions are continuous with each other and with the main die cut portion. The first and second die cut portions may define a neck region of the package integrity feature having a reduced width and configured to tear as an opening force is applied to the package by a user, wherein tearing of the neck region provides access, via the opening, to contents stored within the package in a tamper evident manner. The first and second die cut portions may further define an anchor region configured to resist the opening force applied by the user such that the neck region tears in response to application of the opening force.

In some cases, the package integrity feature may define a nominal width between the first and second die cut portions proximate a juncture between each of the first and second die cut portions and the main die cut portion, wherein the width of the neck region is less than the nominal width of the package integrity feature. In some embodiments, a width of the anchor region may be greater than a nominal width of the package integrity feature. The inner film layer may be disposed adjacent an outer film layer of the package. The inner film layer may be permanently adhered to the outer film layer in an area within a peelable flap portion of the package, and the anchor region and a first part of the package integrity feature, defined between the first and second die cut portions proximate the anchor region, may be permanently adhered to the outer film layer. Additionally or alternatively, a second part of the package integrity feature, defined between the first and second die cut portions on an opposite side of the neck region from the first part, may be adhered to the outer film layer via a pressure sensitive adhesive. In some cases, the anchor region may be circular or elliptical.

In other embodiments, a flexible package may be provided that includes an inner film layer and an outer film layer, where the inner film layer and the outer film layer define a main body defining a compartment configured to hold contents therein and a peelable flap portion configured to be peeled away from the main body by the user. The inner film layer may define a main die cut portion between the peelable flap portion and the main body. The inner film layer may further define at least one package integrity feature extending between the main body and the peelable flap portion. Each package integrity feature may comprises a first die cut portion extending from the main die cut portion and a second die cut portion extending from the main die cut portion. The first and second die cut portions may be continuous with each other and with the main die cut portion.

In some cases, each package integrity feature may comprise a neck region having a reduced width and configured to tear as an opening force is applied to the peelable flap portion by a user to peel the peelable flap portion from the main body and create an opening in the package. Each package integrity feature may further comprise an anchor region configured to resist the opening force applied by the user such that the neck region tears in response to application of the opening force.

The width of the neck region may be less than a nominal width of the package integrity feature. Moreover, a width of the anchor region may be greater than the width of the tamper evident region. The anchor region and a first part of the package integrity feature may be permanently adhered to the outer film layer of the peelable flap portion and a second part of the package integrity feature may be adhered to the outer film layer of the peelable flap portion via pressure sensitive adhesive. An outer perimeter of the peelable flap portion may be defined by an outer die cut formed in the outer film layer, such that the outer die cut and the main die cut portion cooperate to create the peelable flap portion. Additionally or alternatively, the peelable flap portion may comprise a pull tab defined by the outer die cut, wherein the pull tab is grippable by the user to pull the peelable flap portion away from the main body.

In still other embodiments, a method of manufacturing a package having a main body, a peelable flap portion, and a package integrity feature is provided, where the method includes laminating an outer film layer to an inner film layer, wherein a permanent adhesive is pattern applied to an inner surface of a respective one of the inner film layer or the outer film layer and wherein a pressure sensitive adhesive is applied to the inner surface of a peripheral portion of the respective one of the inner or outer film layer. The method may further include forming an outer die cut in a peripheral edge of the peripheral portion of the outer film layer to define a peelable flap portion; forming a main die cut portion in the inner film layer to define a location of an opening of the package; and forming each of first and second die cut portions in the inner film layer continuously with formation of the other of the first and second die cut portions and continuously with formation of the main die cut portion. The first and second die cut portions may define a package integrity feature of the package.

In some cases, forming the first and second die cut portions may comprise defining a neck region of the package integrity feature having a reduced width and configured to tear as an opening force is applied to the package by a user. Tearing of the neck region may provide access, via the opening, to contents stored within the package in a tamper evident manner. Forming the first and second die cut portions may further comprise defining an anchor region configured to resist the opening force applied by the user such that the neck region tears in response to application of the opening force. In some embodiments, the width of the neck region may be less than a nominal width of the package integrity feature, and/or a width of the anchor region may be greater than a nominal width of the package integrity feature.

Additionally or alternatively, forming each of first and second die cut portions may comprise defining the anchor region and a first part of the package integrity feature in a location of the permanent adhesive and defining a second part of the package integrity feature in a location of the pressure sensitive adhesive. In some cases, forming an outer die cut in the peripheral edge of the peripheral portion of the outer film layer may comprise defining a pull tab configured to be gripped by a user for peeling the peelable flap portion away from a main body of the flexible package.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

Figure 1A:
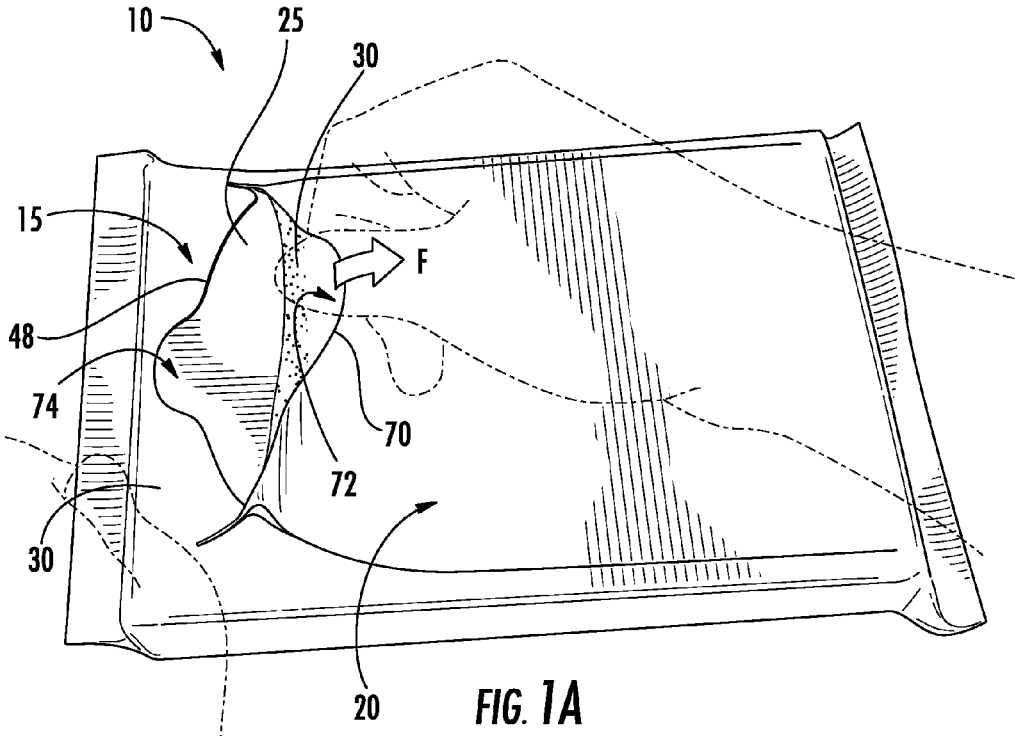
FIGS. 1A-1D illustrate perspective views of a progression of opening a package by peeling a peelable flap portion away from a main body of the package according to an example embodiment.

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements Like numbers refer to like elements throughout.

As noted above, some types of conventional packages, such as packages for holding food items (e.g., cookies), are designed to be resealable to allow a user to reclose the package after dispensing less than the entire contents of the package. For example, a user may open a package of cookies and take out two cookies to eat, then re-close the package to store the remaining cookies inside the package for future consumption. This may be accomplished, for example, using a resealable flap that can be pulled away from the body of the package to reveal an opening, through which the package contents can be accessed, and can likewise be re-adhered to the package body, thereby covering the opening.

In a retail environment, for example, it may be possible for someone who has not bought (and has no intention of buying) the package to prematurely open the package, take one or more of the items contained inside the package, then reseal the package and place the package back on the shelf, effectively stealing from the contents of the package and possibly contaminating the remaining contents. If the package is carefully resealed, a consumer may later purchase the package that has been tampered with, not knowing that the package was previously opened, contents removed, and the package re-closed.

As such, package integrity features have been developed that indicate to a consumer whether the original seal on the package opening has been broken. For example, a package integrity feature may be configured to cause a portion of the packaging to deform in some way the first time the package is opened, and the deformity may be visible even after the package has been resealed, thereby providing a visual indication of the previous opening of the package.

In packages made from flexible films, for example, discontinuous die cuts may be made in one of the layers of packaging film to create an anchor region that, when the package is opened, causes certain areas surrounding the opening to be stretched and torn to provide the desired visual indication of tampering. Such an anchor configuration is illustrated and described, for example, in U.S. Pat. No. 8,408,792 to Cole et al., where an "anchor" is created using two outwardly facing J-curves that are not connected to each other.

Conventional methods of providing tamper evident features, however, have resulted in perceived inconsistencies in the manufacturing and performance of the package integrity features and the related packaging structures. Accordingly, as described below in greater detail, embodiments of the present invention provide for an improved tamper evident feature that has a simpler design with respect to the conventional design, is easier to manufacture and reduces the likelihood of inconsistent die cut depths, and improves the performance of the package integrity feature by encouraging a consistent failure mode in a desired location for opening the package.

Turning now to FIGS. 1A-1D, a flexible package 10 is shown, such as a package designed for holding food items such as cookies 12. The package 10 may include a main body 15 and a peelable flap portion 20. The main body 15, for example, may define a compartment 22 configured to hold contents (e.g., cookies 12) therein. In some embodiments, the peelable flap portion 20 may be configured to be peeled away from the main body 15 by the user, as depicted in FIGS. 1A-1D.

Figure 1B:
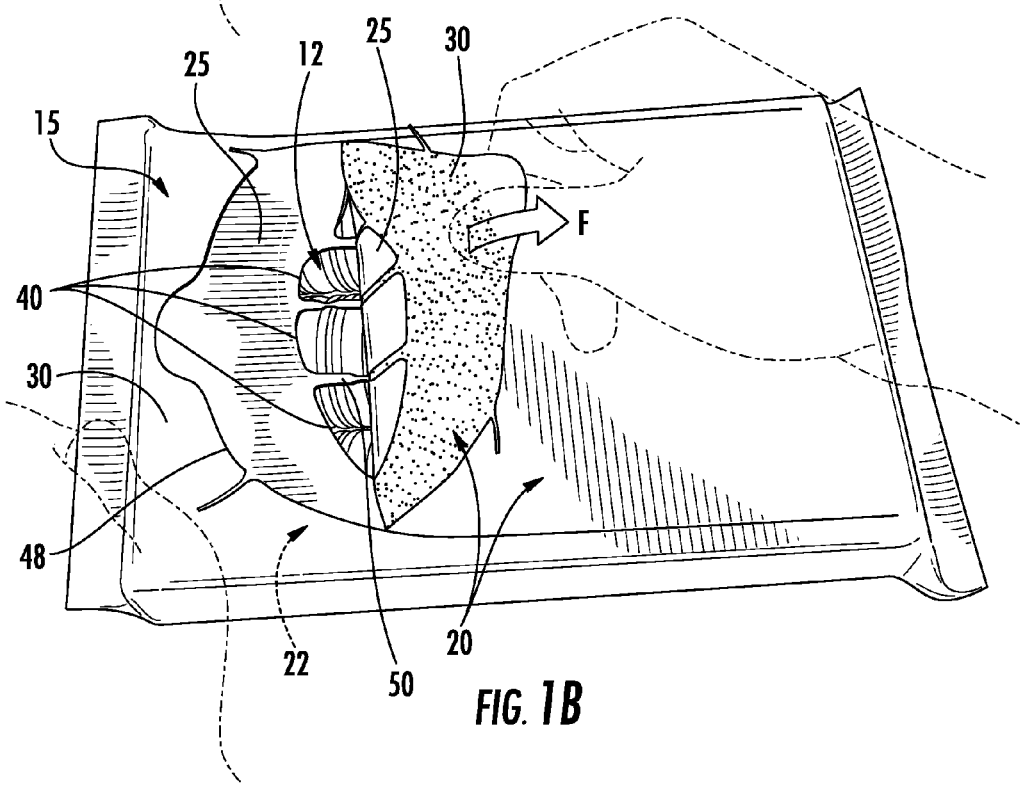
Figure 1C:
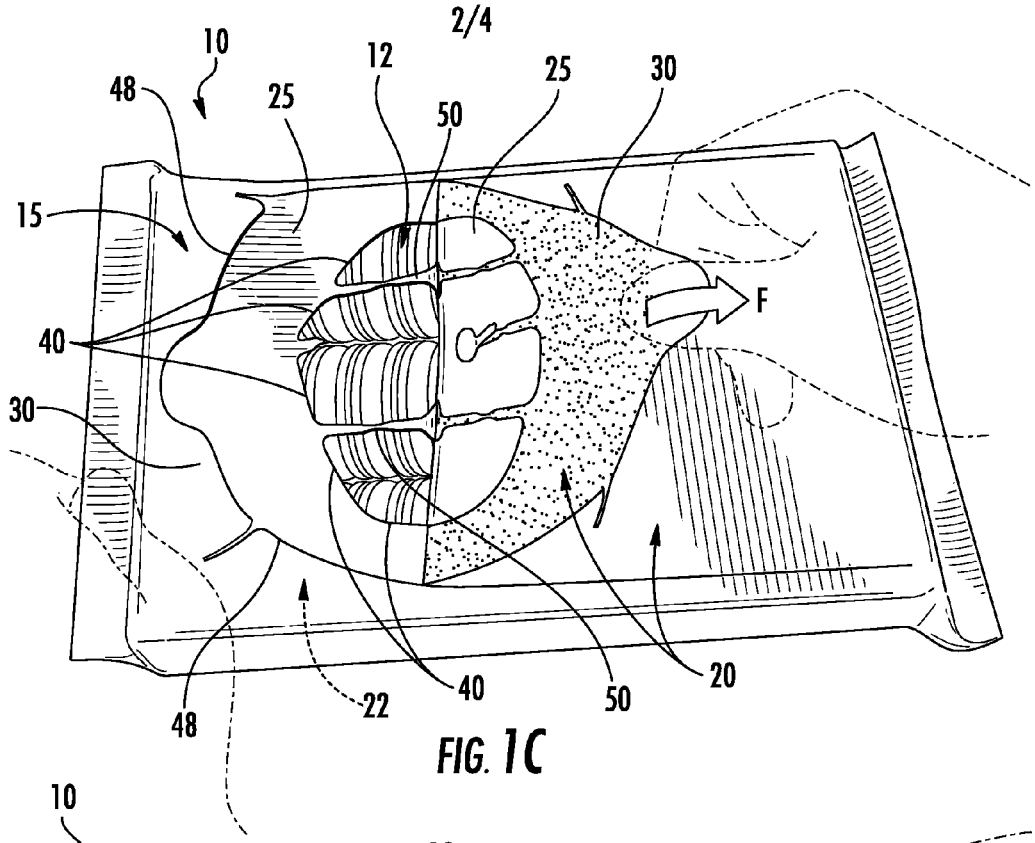
Figure 1D:
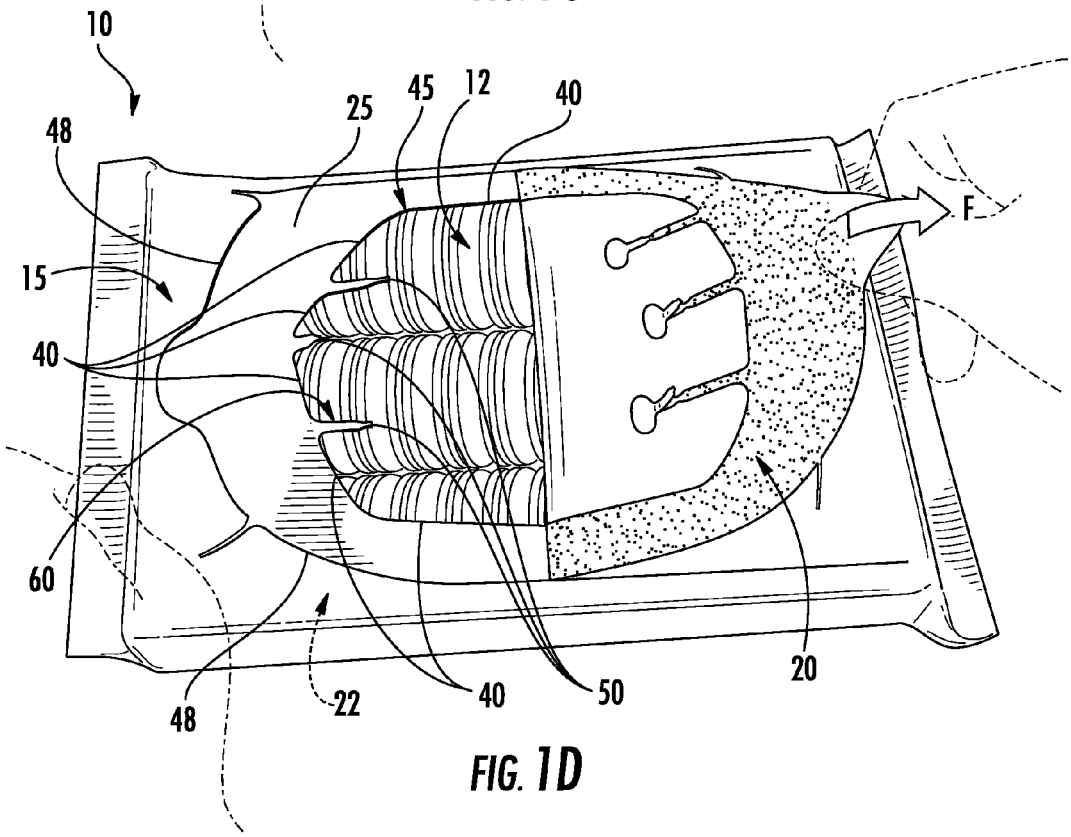

The flexible package 10 may, in some embodiments, include an inner film layer 25 and an outer film layer 30. Accordingly, in some embodiments, the inner and outer film layers 25, 30 may define the main body 15 and the peelable flap portion 20, as described in greater detail below. For example, the inner film layer 25 may define a main die cut portion 40 between the peelable flap portion 20 and the main body 15 (illustrated in FIGS. 1B-1D, showing a partially open configuration of the package 10). Said differently, the main die cut portion 40 may at least partially define an opening 45 of the package 10, through which the contents of the package may be accessed, as illustrated in FIG. 1D.

Moreover, in some embodiments, an outer perimeter of the peelable flap portion 20 may be defined by an outer die cut 48 formed in the outer film layer 30. In this way, the outer die cut 48 and the main die cut portion 40 may cooperate to create the peelable flap portion 20 of the package 10. Thus, in such embodiments, the peelable flap portion 20 may have an area that includes two layers (e.g., the inner film layer 25 and the outer film layer 30), such as in a central portion thereof, and the peelable flap portion 20 may also have an area that includes only one layer (e.g., only the outer film layer 30), such as in a peripheral portion thereof.

In some cases, the peelable flap portion 20 may comprise a pull tab 70 that is defined by the outer die cut 48. The pull tab 70 may be grippable by the user to pull the peelable flap portion 20 away from the main body 15, as shown in FIGS. 1A-1D. For example, the pull tab 70 may have a semi-circular or semi-elliptical shape that extends outwardly from the general shape of the rest of the outer die cut 48, as illustrated in FIG. 1A, for example, and an inner surface 72 of the pull tab 70 (e.g., the surface that contacts or is adjacent to the outer surface 74 of the inner film layer 25) may be devoid of any adhesives between the two layers (described below), such that the pull tab may be easily separated from the package 10 (e.g., by the user sliding a finger between the pull tab 70 and the rest of the package 10). In this way, the user may grasp the pull tab 70 and use it to pull the peelable flap portion 20 away from the main body 15 of the package 10, as illustrated in FIGS. 1A-1D and described above.

The inner film layer 25 may further define at least one package integrity feature 50 extending between the main body 15 and the peelable flap portion 20. The package 10 depicted in FIGS. 1A-1D, for example, includes three package integrity features 50, as shown.

Figure 2:
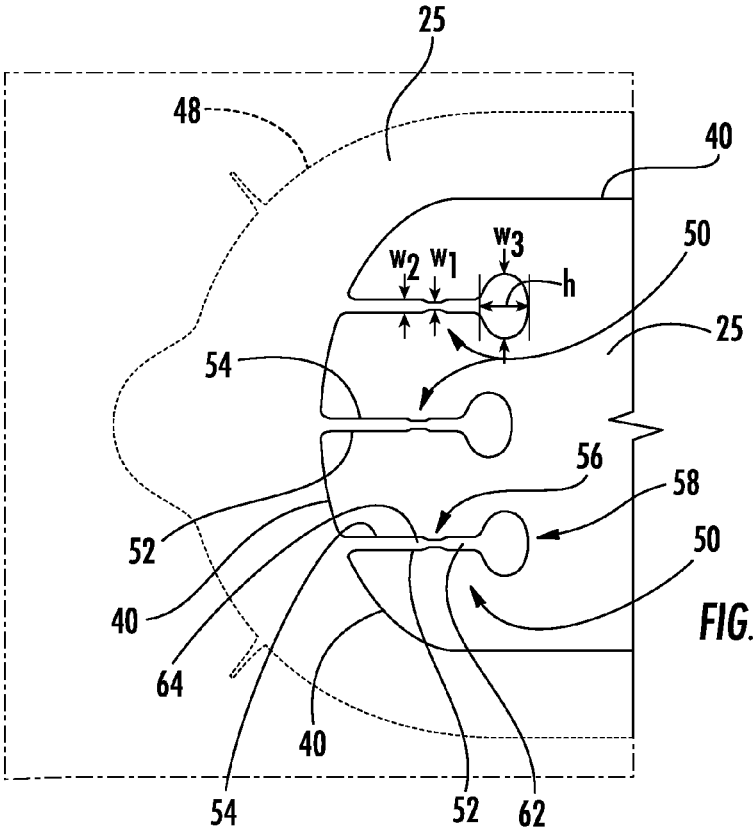
FIG. 2 is a view from the inner film layer-side of the top of the package shown in FIGS. 1A-1D according to an example embodiment.
Figure 3:
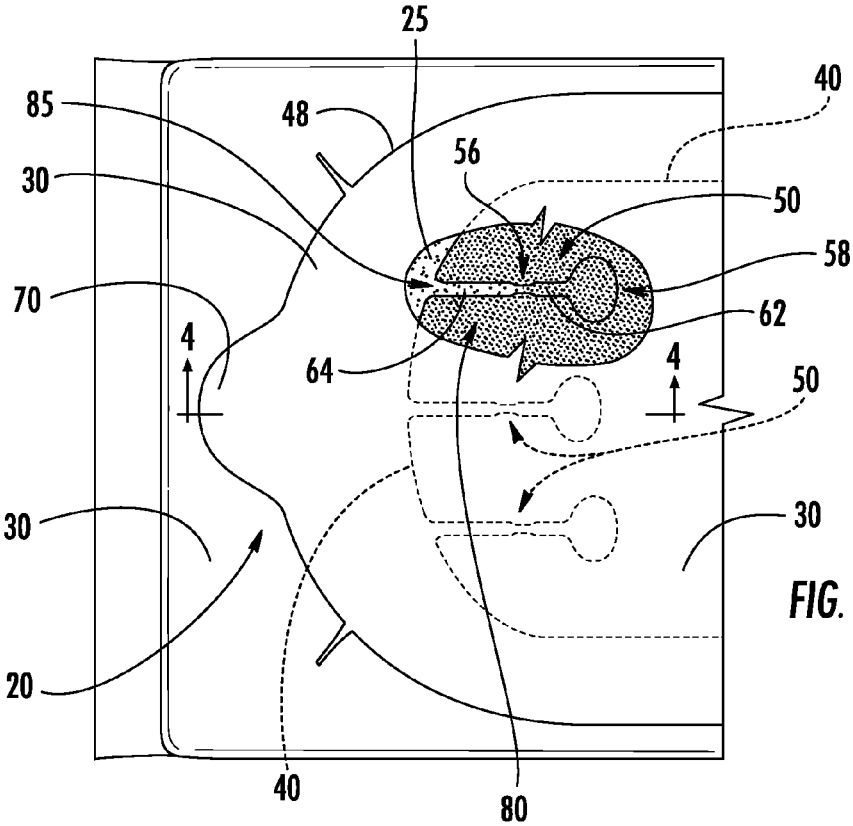
FIG. 3 is a view from the outer film layer-side of the top of the package shown in FIGS. 1A-1D according to an example embodiment.

FIGS. 2 and 3 provide a close-up view of the package integrity features 50. With reference to FIG. 2, for example, each package integrity feature 50 may comprise a first die cut portion 52 extending from the main die cut portion 40 and a second die cut portion 54 extending from the main die cut portion 40. In contrast with some conventional package integrity features, in which the die cut portions forming each package integrity feature are discontinuous and consist of separate die cuts (e.g., in an anchor region), according to embodiments of the present invention the first and second die cut portions 52, 54 are continuous with each other and with the main die cut portion 40, such that a single, continuous cut line forms the main die cut portion 40, the first die cut portion 52, and the second die cut portion 54.

In some embodiments, each package integrity feature 50 may comprise a neck region 56 and an anchor region 58, as illustrated in FIG. 2. The neck region 56 may have a reduced width and may be configured to tear as an opening force F (shown in FIGS. 1A-1D) is applied to the peelable flap portion 20 by a user to peel the peelable flap portion from the main body 15 and create the opening 45 of the package. The anchor region 58 may be configured to resist the opening force F applied by the user such that the neck region 56 tears in response to application of the opening force F to the respective package integrity feature 50 (e.g., tearing when the opening force experienced by the particular package integrity feature reaches a certain threshold amount of force).

In FIGS. 1A and 1B, for example, the user has not yet applied an adequate amount of opening force F over a great enough distance (e.g., has not peeled the peelable flap portion 20 far enough back) to tear any of the package integrity features 50; in FIG. 1C, one of the package integrity features 50 (the centrally located one) has experienced an amount of opening force F sufficient to cause that package integrity feature to tear at its neck region 56; and in FIG. 1D, each of the three depicted package integrity features 50 have experienced the sufficient amount of opening force F to tear at the respective neck regions 56. In other words, because one end of each package integrity feature 50 is connected to the peelable flap portion 20 via the anchor region 58 and the other end of the respective package integrity feature is connected to the main body 15 of the package, and because the peelable flap portion is being pulled away from the main body by the user's action of opening the package 10 as shown in FIGS. 1A-1D, each package integrity feature 50 is stretched until the point at which it tears (e.g., at the neck region 56, as illustrated).

Once torn, the now permanently deformed (and no longer intact) package integrity features 50 serve as visual indications that the package 10 has been opened and, thus, provide evidence of tampering. In some cases, the package integrity features 50 may also provide a tactile indication of tampering, as the opening of a package may feel "more difficult" or provide greater resistance to opening when the package integrity features are intact (prior to the first opening) than after the package has been opened. Accordingly, in some embodiments, each package integrity feature 50 may define a nominal width, e.g., proximate a juncture between each of the first and second die cut portions 52, 54 and the main die cut portion 40 and/or proximate a juncture between each of the first and second die cut portions and the anchor region 58. Thus, in some embodiments, the width $w_1$ of the neck region 56 may be less than the nominal width $w_2$ of the package integrity feature 50 so as to encourage failure (e.g., tearing) of the package integrity feature 50 at the neck region, instead of elsewhere on the package integrity feature. Moreover, in some embodiments, the width $w_3$ of the anchor region 58 may be greater than the nominal width $w_2$ of the package integrity feature 50, in addition to being greater than the width $w_1$ of the neck region 56. In this way, the anchor region 58 may have sufficient surface area to remain secured to the peelable flap portion 20, as described below, such that the tearing of the package integrity feature 50 occurs at the neck region 56 and causes a portion 60 of the package integrity feature 50, once torn, to "hang down" from the main body 15 as a visual indication of tampering, as stated above and depicted in FIG. 1D.

In this regard, in some embodiments, the anchor region 58 may be specifically configured (e.g., sized and shaped) so as to maintain a secure attachment to the outer film layer 30 of the peelable flap portion 20, e.g., as a result of adhesives applied between adjacent, contacting surfaces of the inner and outer film layers 25, 30 in the area of the anchor region 58. For example, in some embodiments, the anchor region 58 may be configured to be circular or elliptical, as shown, e.g., in FIG. 2. Although various configurations (sizes and shapes) of the anchor region 58 may be used to achieve different surface areas over which the inner film layer 25 of the anchor region 58 may be adhered to the outer film layer 30 of the peelable flap portion, a larger anchor region 58 may generally yield a package integrity feature 50 that performs more consistently. This is because as the surface area of the anchor region 58 increases, more shear force is required to pull it apart, which in turn causes the neck region 56 of the package integrity feature 50 to fail first.

Figure 4:
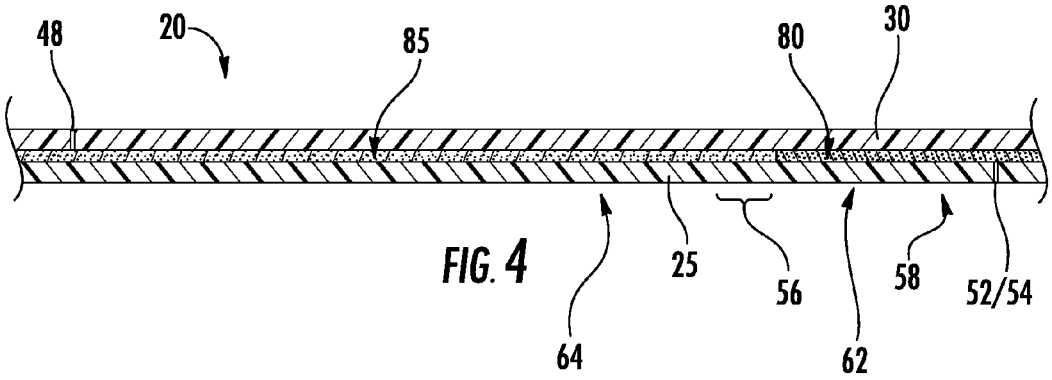
FIG. 4 is a partial cross-sectional view of the top of the package shown in FIG. 3 according to an example embodiment.

In some cases, the package integrity feature 50 may have a first part 62 on one side of the neck region 56 and a second part 64 on the other side of the neck region 56, as shown in FIGS. 2 and 3. With reference also to FIG. 4, the anchor region 58 and the first part 62 of the package integrity feature 50 may, for example, be permanently adhered to the outer film layer 30 of the peelable flap portion 20 (e.g., via permanent adhesive 80), and the second part 64 of the package integrity feature may be adhered to the outer film layer 30 of the peelable flap portion 20 via pressure sensitive adhesive 85. As such, the opening force F applied as the user is peeling the peelable flap portion 20 away from the main body 15 (as shown in FIGS. 1A-1D), such as via the pull tab 70, may cause the outer film layer 30 to be separated from the inner film layer 25 in the area of the peelable flap portion 20 between the outer die cut 48 and the main die cut portion 40, as well as in the second part 64 (FIGS. 2 and 3) of the package integrity feature 50, where the pressure sensitive adhesive 85 is present.

As the user continues to pull the peelable flap portion 20, the increased attachment force between the inner and outer film layers 25, 30 in the area of the first part 62 of the package integrity feature should cause the package integrity feature 50 to tear at or near the neck region 56. In some cases, the inner and outer film layers 25, 30 may at least partially delaminate in areas in which permanent adhesive 80 is applied, such as in the first part 62 of the package integrity feature 50 and/or in a portion of the anchor region 58 (as illustrated in FIG. 1C, for example); however, embodiments of the invention provide an anchor region that is configured (e.g., sized and shaped) such that the surface area of the adhesion between the inner film layer and the outer film layer within the anchor region is sufficient to withstand the amount of opening force F required to tear the package integrity feature 50 at the neck region 56, as described above.

Accordingly, a method of manufacturing a package having a main body, a peelable flap portion, and a package integrity feature as described above is also provided according to some embodiments. The method may comprise laminating an outer film layer 30 to an inner film layer 25, wherein a permanent adhesive 80 is pattern applied to an inner surface of a respective one of the inner film layer or the outer film layer (e.g., where the inner surface is the surface of the respective film layer that is to be in contact with a corresponding inner surface of the other film layer). A pressure sensitive adhesive 85 may be applied to the inner surface of a peripheral portion of the respective one of the inner or outer film layer, such as to surround a central area in which permanent adhesive 80 is applied (e.g., as illustrated in FIGS. 3 and 4). The peripheral portion may be, for example, an area that generally extends between the outer die cut 48 and the main die cut portion 40.

As described above, an outer die cut 48 may be formed in a peripheral edge of the peripheral portion of the outer film layer 30 to define the peelable flap portion 20, and a main die cut portion 40 may be formed in the inner film layer 25 to define a location of an opening of the package. Each of first and second die cut portions 52, 54 may also be formed in the inner film layer 25. The first and second die cut portions 52, 54 may be formed continuously with each other (e.g., via a single cutting action) and also continuously with formation of the main die cut portion 40. As such, the first and second die cut portions 52, 54 may define a package integrity feature 50, as described above.

In some embodiments, forming the first and second die cut portions 52, 54 may comprise defining a neck region 56 of the package integrity feature 50 having a reduced width that is configured to tear as an opening force is applied to the package by a user, such that tearing of the neck region provides access, via the opening, to contents stored within the package in a tamper evident manner. Moreover, forming the first and second die cut portions 52, 54 may further comprise defining an anchor region 58 configured to resist the opening force applied by the user such that the neck region tears in response to application of the opening force.

The anchor region 58 may, in some cases, be defined with a first part 62 of the package integrity feature 50 in a location of the permanent adhesive 80, as described above and illustrated in FIGS. 3 and 4. A second part 64 of the package integrity feature 50 may be defined in a location of the pressure sensitive adhesive 85. Moreover, a pull tab 70 may be defined as part of forming an outer die cut 48 in the peripheral edge of the peripheral portion of the outer film layer 30, and the pull tab may be configured to be gripped by a user for peeling of the peelable flap portion 20 away from the main body 15 of the flexible package 10. For example, at least part of the pull tab 70 may not be adhered to the corresponding surface of the inner film layer 25, such as by not having any permanent or pressure sensitive adhesive applied between the two film layers in that area. In addition, the pull tab 70 may have a size and/or shape that is conducive to being gripped by the user and pulled.

Embodiments of the package integrity feature 50 described above, in particular with respect to the formation of the package integrity feature using first and second die cut portions that are continuous with each other and with the main die cut portion from which they extend, allow for better performance of the package integrity features and result in a simpler design that is easier to manufacture and is more consistently produced from package to package. The use of a continuous cut to create the package integrity feature, for example, reduces the likelihood of inconsistent die-cut depths along the length of the die cut (main die cut portion, first die cut portion, and second die cut portion). For example, according to some embodiments, the cut depths are made to a tolerance of within approximately 8-9 μ. In addition, the continuous nature of the die cut described above results in better performance of the package integrity feature by ensuring that the package integrity feature breaks away from the package before reaching the permanent adhesive area (or with minimal delamination of the permanent adhesive area), such that the package integrity feature is able to tear at or near the neck region when the package is opened.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A package integrity feature defined by an inner film layer of a package, the package integrity feature comprising:

a first die cut portion extending from a main die cut portion, wherein the main die cut portion at least partially defines an opening of the package; and a second die cut portion extending from the main die cut portion, wherein the first and second die cut portions are continuous with each other and with the main die cut portion, and wherein the first and second die cut portions define:

a neck region of the package integrity feature having a reduced width and configured to tear as an opening force is applied to the package by a user, wherein tearing of the neck region provides access, via the opening, to contents stored within the package in a tamper evident manner, and an anchor region configured to resist the opening force applied by the user such that the neck region tears in response to application of the opening force.

2. The package integrity feature of claim 1, wherein the package integrity feature defines a nominal width between the first and second die cut portions proximate a juncture between each of the first and second die cut portions and the main die cut portion, wherein the width of the neck region is less than the nominal width of the package integrity feature.

3. The package integrity feature of claim 1, wherein a width of the anchor region is greater than a nominal width of the package integrity feature.

4. The package integrity feature of claim 1, wherein the inner film layer is disposed adjacent an outer film layer of the package.

5. The package integrity feature of claim 4, wherein the inner film layer is permanently adhered to the outer film layer in an area within a peelable flap portion of the package, wherein the anchor region and a first part of the package integrity feature, defined between the first and second die cut portions proximate the anchor region, are permanently adhered to the outer film layer.

6. The package integrity feature of claim 5, wherein a second part of the package integrity feature, defined between the first and second die cut portions on an opposite side of the neck region from the first part, is adhered to the outer film layer via a pressure sensitive adhesive.

7. The package integrity feature of claim 1, wherein the anchor region is circular or elliptical.

8. A flexible package comprising an inner film layer and an outer film layer, wherein the inner film layer and the outer film layer define:

a main body defining a compartment configured to hold contents therein; and a peelable flap portion configured to be peeled away from the main body by the user, wherein the inner film layer defines a main die cut portion between the peelable flap portion and the main body, wherein the inner film layer further defines at least one package integrity feature extending between the main body and the peelable flap portion, and wherein each package integrity feature comprises:

a first die cut portion extending from the main die cut portion, and a second die cut portion extending from the main die cut portion, and wherein the first and second die cut portions are continuous with each other and with the main die cut portion.

9. The flexible package of claim 8, wherein each package integrity feature comprises:

a neck region having a reduced width and configured to tear as an opening force is applied to the peelable flap portion by a user to peel the peelable flap portion from the main body and create an opening in the package, and an anchor region configured to resist the opening force applied by the user such that the neck region tears in response to application of the opening force.

10. The flexible package of claim 8, wherein the width of the neck region is less than a nominal width of the package integrity feature.

11. The flexible package of claim 8, wherein a width of the anchor region is greater than the width of the tamper evident region.

12. The flexible package of claim 8, wherein the anchor region and a first part of the package integrity feature are permanently adhered to the outer film layer of the peelable flap portion and a second part of the package integrity feature is adhered to the outer film layer of the peelable flap portion via pressure sensitive adhesive.

13. The flexible package of claim 8, wherein an outer perimeter of the peelable flap portion is defined by an outer die cut formed in the outer film layer, such that the outer die cut and the main die cut portion cooperate to create the peelable flap portion.

14. The flexible package of claim 13, wherein the peelable flap portion comprises a pull tab defined by the outer die cut, wherein the pull tab is grippable by the user to pull the peelable flap portion away from the main body.

15. A method of manufacturing a package having a main body, a peelable flap portion, and a package integrity feature, the method comprising:

laminating an outer film layer to an inner film layer, wherein a permanent adhesive is pattern applied to an inner surface of a respective one of the inner film layer or the outer film layer and wherein a pressure sensitive adhesive is applied to the inner surface of a peripheral portion of the respective one of the inner or outer film layer;

forming an outer die cut in a peripheral edge of the peripheral portion of the outer film layer to define a peelable flap portion;

forming a main die cut portion in the inner film layer to define a location of an opening of the package;

forming each of first and second die cut portions in the inner film layer continuously with formation of the other of the first and second die cut portions and continuously with formation of the main die cut portion, wherein the first and second die cut portions define a package integrity feature of the package.

16. The method of claim 15, wherein forming the first and second die cut portions comprises:

defining a neck region of the package integrity feature having a reduced width and configured to tear as an opening force is applied to the package by a user, wherein tearing of the neck region provides access, via the opening, to contents stored within the package in a tamper evident manner, and defining an anchor region configured to resist the opening force applied by the user such that the neck region tears in response to application of the opening force.

17. The method of claim 16, wherein the width of the neck region is less than a nominal width of the package integrity feature.

18. The method of claim 16, wherein a width of the anchor region is greater than a nominal width of the package integrity feature.

19. The method of claim 16, wherein forming each of first and second die cut portions comprises defining the anchor region and a first part of the package integrity feature in a location of the permanent adhesive and defining a second part of the package integrity feature in a location of the pressure sensitive adhesive.

20. The method of claim 15, wherein forming an outer die cut in the peripheral edge of the peripheral portion of the outer film layer comprises defining a pull tab configured to be gripped by a user for peeling the peelable flap portion away from a main body of the flexible package.

21. The package integrity feature of claim 3, wherein the width of the anchor region is greater than the width of the neck region.

22. The package integrity feature of claim 5, wherein the anchor region is configured to have sufficient surface area to remain secured to the peelable flap such that tearing of the packing integrity feature occurs at the neck region.

23. The flexible package of claim 10, wherein the width of the anchor region is greater than the width of the neck region.

24. The flexible package of claim 8, wherein the anchor region is configured to have sufficient surface area to remain secured to the peelable flap such that tearing of the packing integrity feature occurs at the neck region.

* * * * *